United States Patent [19]

Uchida et al.

[11] 4,121,409

[45] Oct. 24, 1978

[54] YARN PIECING AND KNOTTING DEVICE FOR PNEUMATIC SPINNING APPARATUS

[75] Inventors: Hiroshi Uchida, Kyotoshi; Kunio Umeda, Ohmi Hachimanshi; Zenpei Tachibana, Nishinomiyashi; Nobunori Kubota, Nagaokakyoshi, all of Japan

[73] Assignee: Murata Kikai Kabushiki Kaisha, Japan

[21] Appl. No.: 808,463

[22] Filed: Jun. 21, 1977

[30] Foreign Application Priority Data

Jun. 25, 1976 [JP] Japan ..... 51-75930

[51] Int. Cl.[2] ..... D01H 15/00

[52] U.S. Cl. ..... 57/22; 57/34 R; 57/34.5; 242/37 A

[58] Field of Search ..... 57/22, 23, 34 R, 34.5, 57/91, 107; 242/37 A

[56] References Cited

U.S. PATENT DOCUMENTS

| | | | |
|---|---|---|---|
| 3,198,446 | 8/1965 | Furst et al. | 57/34 R X |
| 3,938,306 | 2/1976 | Bous | 57/34 R |

*Primary Examiner*—Charles Gorenstein
*Attorney, Agent, or Firm*—Whittemore, Hulbert & Belknap

[57] ABSTRACT

A yarn piecing and knotting device for use in a pneumatic spinning machine for spinning slivers directly into a yarn by air jetting nozzles is disclosed. This yarn knotting device comprises means for retaining a spun yarn temporarily during a period ranging from the time of completion of the operation of a yarn knotter for connecting the spun yarn with a yarn taken out of a package to the time of resumption of winding.

13 Claims, 14 Drawing Figures

YARN PIECING AND KNOTTING DEVICE FOR PNEUMATIC SPINNING APPARATUS

BACKGROUND OF THE INVENTION

The present invention relates to a yarn piecing and knotting device to be used when a yarn breakage takes place in a so-called pneumatic spinning process as disclosed in U.S. Pat. No. 3,079,746 or U.S. Pat. No. 3,978,648 in which a sliver is spun into a yarn by passing the sliver through an air jetting nozzle and false-twisting it by a swirling stream of air jetted from the air jetting nozzle.

In the pneumatic spinning process as described above, since spinning cannot be interrupted even during the yarn knotting operation, a conventional yarn piecing device as customarily used for a winder or the like cannot be directly used as the yarn piecing up means.

As the known means for performing the yarn piecing-up operation without interruption of spinning, there is known a device disclosed in British Pat. No. 1,357,422.

This yarn piecing and knotting device is for use in a so-called open-end spinning process using a rotary rotor. More specifically, a yarn continuously spun by the rotary rotor is caught by a suction pipe and knotted to the end of a yarn on a winding package by a knotter, and the yarn excessively spun during a period ranging from the point of completion of the operation of the knotter to the point of resumption of the winding operation is temporarily retained on a metal net by sucking and attracting the yarn onto the metal wire and on resumption of the winding operation the winding package is rotated at a high speed to wind the excessively spun yarn retained on the metal net onto the winding package. As is well known in the art, in the open-end spinning process, the spinning speed is 60 m/min at highest and hence, the length of the yarn retained on the metal net is extremely short. Accordingly, the yarn knotting operation can be accomplished sufficiently by the above-mentioned yarn knotting mechanism. However, in case of the pneumatic spinning process, the spinning speed is as high as 150 to 250 m/min, and at such high spinning speed the excessively spun yarn is as long as 10 to 30 cm even if the yarn knotter is operated at a speed as high as possible. Accordingly, when the above-mentioned yarn piecing and knotting mechanism is used in the pneumatic spinning process, the excessively spun yarn is deposited and accumulated in the folded state on the metal net. Such defects as entanglements, and loops are thus formed on the yarn, and a kinky thread is produced. If loops and kinks are once formed, they cannot easily be eliminated by pulling the yarn, and the resulting yarn has a fatal defect in quality.

Such excessively spun yarn can be temporarily retained by using a wire instead of the above-mentioned metal net-equipped suction pipe and bending the yarn by this wire. Since the residual torque in a yarn obtained by the pneumatic spinning process is high and kinky threads are readily formed, when the bending is released after resumption of the winding operation, if the rate of release of the bending is higher than the yarn take-up rate of the winding package only a bit, the yarn is slackened and kinky threads are immediately formed. Accordingly, this method is defective in that adjustment of the release of the bending is very difficult.

SUMMARY OF THE INVENTION

It is a primary object of the present invention to provide a yarn piecing and knotting device suitable for use in the pneumatic spinning process, in which various defects and disadvantages caused when the conventional yarn piecing and knotting techniques are applied to the pneumatic spinning process can be eliminated.

The present invention relates to a device in which when a yarn breakage takes place during spinning, a yarn excessively spun during a period ranging from the point of completion of the yarn knotting operation to the point of resumption of the winding operation is temporarily retained. More specifically, in the present invention, a excessively spun yarn is temporarily retained by applying to the yarn an air stream formed by sucked air or jetted air or both sucked air and jetted air to form a U-shaped slack in the yarn. According to the present invention, entanglement of the yarn or reduction of the tension is avoided by formation of this U-shaped slack and hence, formation of loops and kinky threads can be prevented.

Since such U-shaped slack is formed by the force of air, this slack is gradually eliminated under a constant tension while the yarn is wound by rotation of the package and the normal winding state can be smoothly restored.

In the present invention, as the yarn slackening means there is employed a yarn slackening suction pipe having a clearance which is flat as a whole and has a long slit-like section extending in the direction of a yarn passage, and by using this suction pipe, a good U-shaped slack can be formed in excessively spun yarn.

DETAILED DESCRIPTION OF THE PREFERRED EMBODIMENTS

The present invention will now be described in detail by reference to the accompanying drawing.

Figure 1:
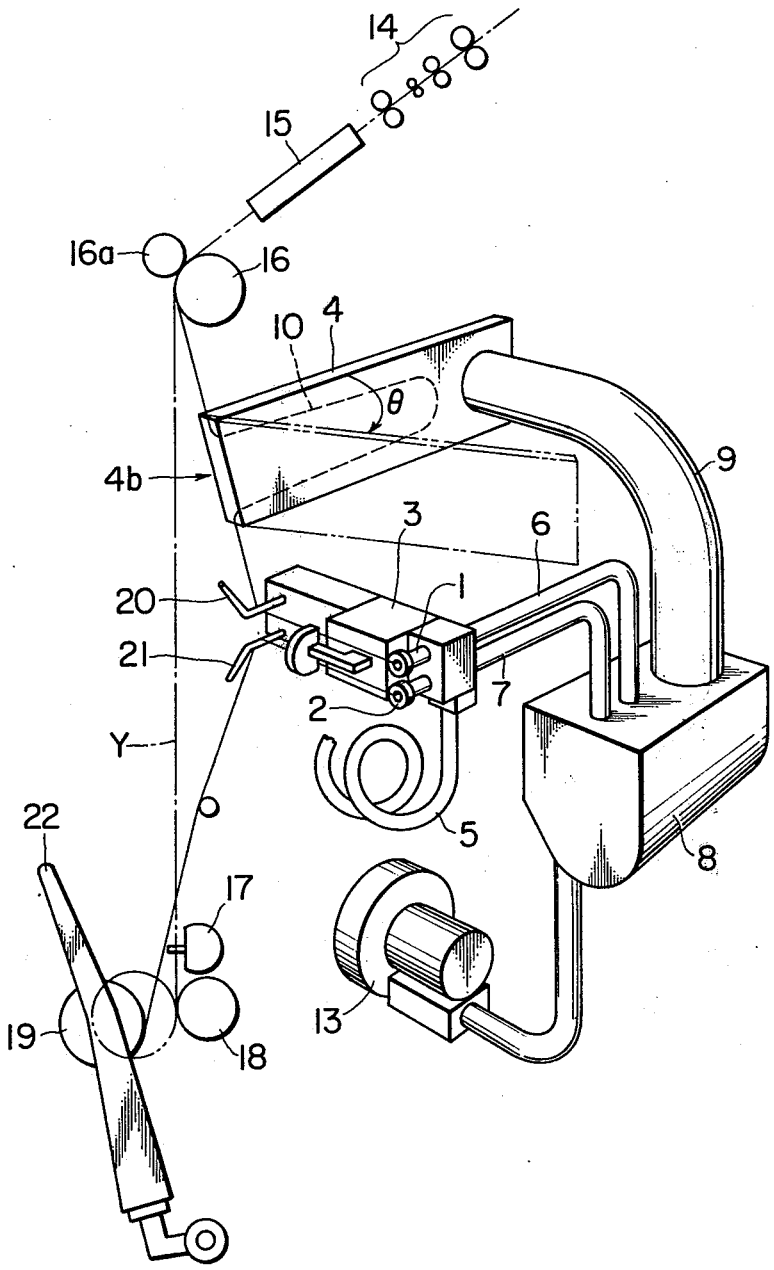
FIG. 1 is a perspective view illustrating the outline of the yarn piecing and knotting device of the present invention.

Referring now to FIG. 1, the yarn piecing and knotting device of the present invention consists essentially of a spun yarn suction pipe 1, a wound yarn suction pipe 2, a knotter 3 and a yarn slackening suction pipe 4. The suction pipes 1 and 2 are constructed as an injector nozzle receiving compressed air from a compressed air pipe 5, and exhaust pipes 6 and 7 of the injector nozzle are connected to a filter box 8.

Figure 3:
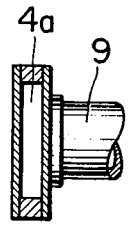
FIG. 3 is a view showing the section taken along the line III—III in FIG. 2.
Figure 2:
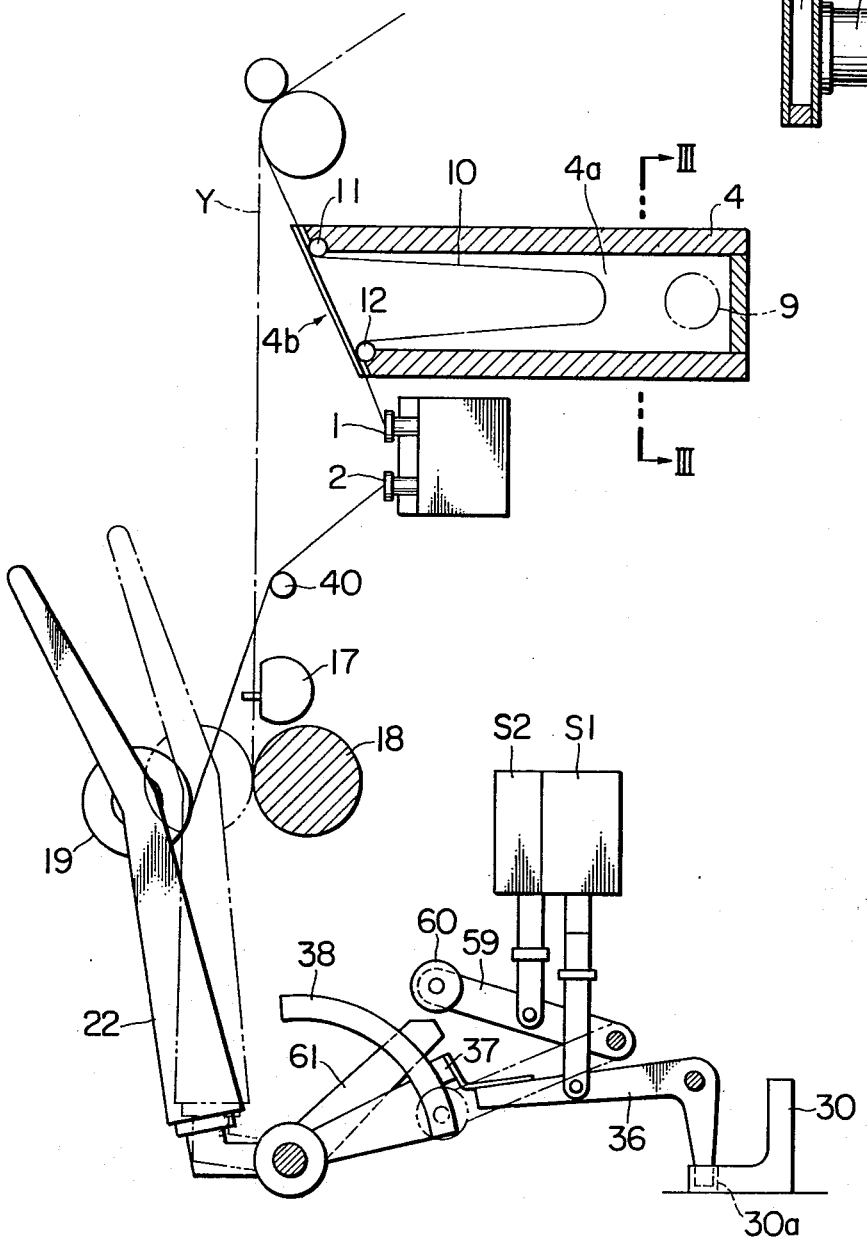
FIG. 2 is a side view illustrating diagrammatically operations of a yarn slackening suction pipe and a cradle arm.
Figure 5:
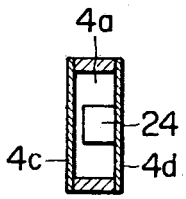
FIG. 5 is a view illustrating the section taken along the line V—V in FIG. 4.
Figure 4:
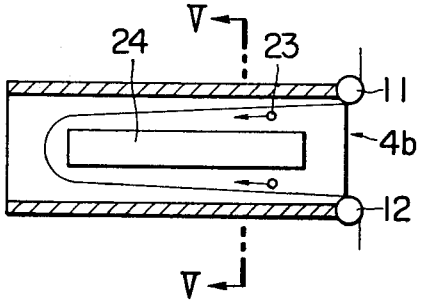
FIG. 4 is a sectional view illustrating another embodiment of the yarn slackening suction pipe.
Figure 6:
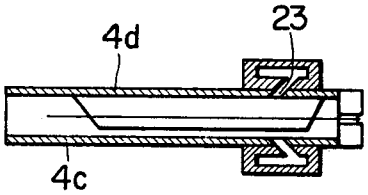
FIG. 6 is a plan view showing the lateral section of the yarn slackening suction pipe shown in FIGS. 4 and 5.

As shown in FIGS. 2 and 3, the yarn slackening suction pipe 4 has a flat clearance 4*a* having a slit-like section and also has a yarn sucking opening 4*b* at the front end. The rear end of the yarn slackening suction pipe 4 is closed and an air suction pipe 9 is connected to the yarn slackening suction pipe 4 in the vicinity of the rear end thereof, whereby a U-shaped slack 10 is formed in the yarn by a sucked air stream formed by the suction pipe 9. In FIG. 1, the air suction pipe 9 is connected to a blower 13 through the filter box 8. Reference numerals 11 and 12 represent yarn guide pins, and reference numerals 14, 15 and 16 represent a draft roller, a fluid jetting spinning nozzle and a take-out roller, respectively.

At the yarn knotting operation, a yarn spun from the nozzle 15 is caught and hung on the take-out roller 16 and is sucked by the suction pipe 1 so as to hang it on a guide 20. At this point, the yarn between the take-out roller 16 and the guide 20 runs along a suction opening of the slackening suction pipe 4, and the yarn between the guide 20 and the suction pipe 1 passes through the knotter 3 and the spun yarn is collected in the filter box 8 through the exhaust pipe 6. Further, the yarn taken out of a package 19 is guided by a guide 21 and is sucked through the yarn knotter 3 by the suction pipe 2.

When the above-mentioned stand-by state is attained, the spun yarn is knotted with the wound yarn, and simultaneously or slightly after the knotting operation, a cradle arm 22 is pressed to press the package 19 toward a driving roller 18 and it is rotated to start the winding operation again. The yarn excessively spun during a period ranging from the time of initiation of the operation of the knotter to the time when the winding package 19 resumes normal rotation and the yarn present between the guides 20 and 21 and the knotter 3 are temporarily retained in the yarn slackening suction pipe 4 as the yarn slack 10. The peripheral speed of the driving roller 18 is maintained at a level slightly higher than the peripheral speed of the take-out roller 16, and the yarn slack 10 is gradually eliminated by normal rotation of the winding package and finally, a normal yarn passage Y is restored. Incidentally, the moment the package 19 falls in contact with the roller 18, the yarn is hung on a traverse guide.

FIGS. 4 to 8 illustrate other embodiments of the yarn slackening suction pipe 4, in which jetting pipes 23 are disposed on the side walls 4*c* and 4*d* to jet air toward the rear end of the suction pipe. In these instances, the rear end of the pipe 4 is opened.

In these instances of the slackening suction pipe 4 utilizing jetted air, the amount of air consumed can be reduced, but a turbulence is readily caused in the downstream portion of the air stream to cause entanglements in the yarn. However, this disadvantage can easily be eliminated. More specifically, a separator 24 extending in the longitudinal direction is fixed to one side wall at the center of the clearance 4*a* to separate the clearance 4*a* into upper and lower parts, whereby entanglements of the yarn in the slackened portion can be effectively prevented.

Figure 7:
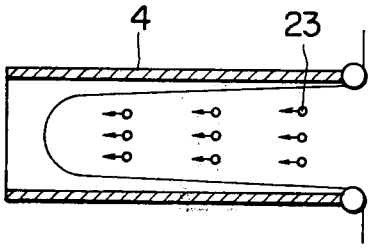
FIG. 7 is a longitudinally sectional view illustrating still another embodiment of the yarn slackening suction pipe.

When, as shown in FIG. 7, a plurality of jetting pipes are arranged in a direction perpendicular to the longitudinal direction of the yarn slackening suction pipe or a plurality of compressed air jetting openings are formed in the longitudinal direction of the yarn slackening suction pipe, the turbulence of the air stream is reduced and a good U-shaped yarn slack can be attained.

Figure 8:
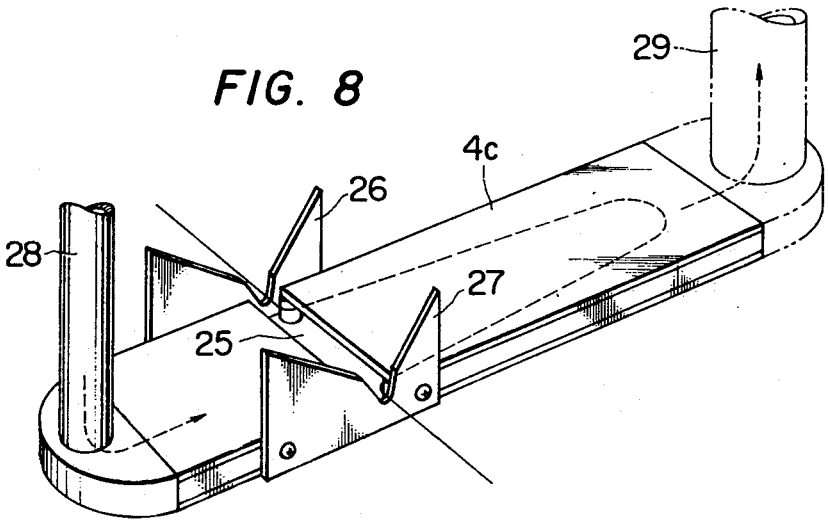
FIG. 8 is a perspective view showing still another embodiment of the yarn slackening suction pipe.
Figure 9:
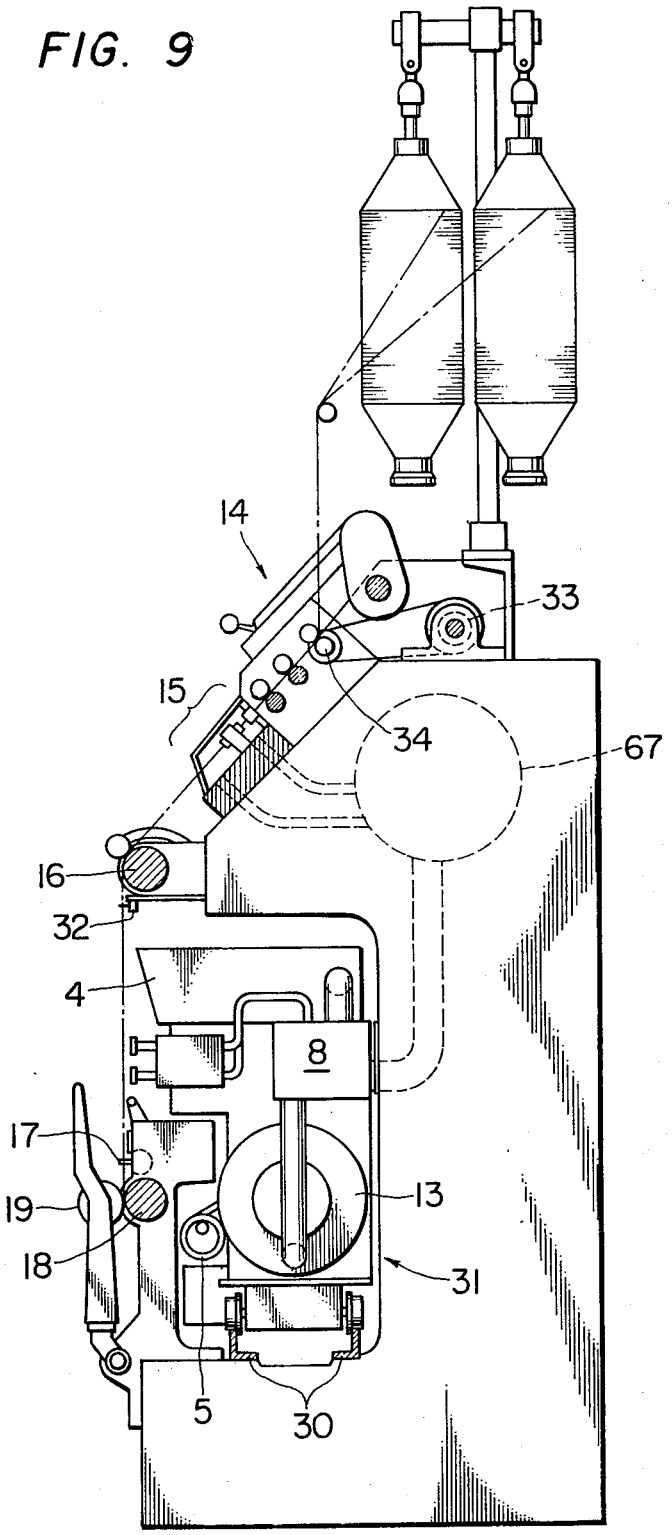
FIG. 9 is a side view illustrating the entire structure of a spinning apparatus to which the present invention is applied.

In the instance illustrated in FIG. 8, a slit 25 is formed on one side wall, and the yarn is inserted into the slit 25 by means of guides 26 and 27. An air blow-out pipe 28 is disposed on one end of the yarn slackening suction pipe. In this case, if an air suction pipe 29 is connected to the other end, much better results can be obtained.

Specific operations of the piecing and knotting device of the present invention having the above structure will now be described by reference to FIGS. 2 and 9 to 13.

Figure 13:
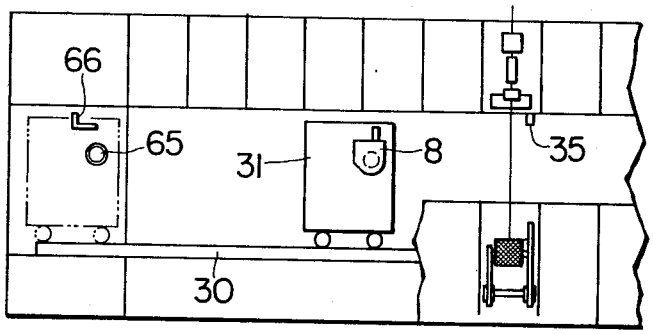
FIG. 13 is a front view illustrating diagrammatically the entire arrangement of the spinning apparatus.

The piecing device shown in FIG. 13 is disposed on a truck 31 running on a rail 30. When a yarn breakage takes place, a clutch 33 is disengaged by a feeler 32 shown in FIG. 9 and a back roller 34 is stopped to interrupt spinning. Simultaneously, an instructing piece 35 (shown in FIG. 13) is projected from a spinning unit and a solenoid S1 is projected by the instructing piece 35, whereby one end of a lever 36 is fitted in a recess 30*a* of the rail 30 to set the position of the truck 31. A brake shoe 37 at the other end of the lever 36 is pressed to a fan-shaped lever 38 integrated with the cradle arm 22. In this state, an operator depresses a first button 39 to start the suction operation in the suction pipes 1 and 2, and the cradle arm 22 is inclined to the position indicated by a solid line in FIG. 2 to separate the package 19 from the roller 18, and the wound yarn is taken out of the package and sucked onto the suction pipe 2. At this time, the yarn is kept in the state taken out of a traverse device 17 by means of a guide 40. Separately, a starting button for the spinning unit is depressed to engage the clutch 33, whereby spinning is started and the spun yarn is sucked onto the suction pipe 1. At this point, the wound yarn Y1 and spun yarn Y2 are kept in the state shown in FIG. 10.

Figure 10:
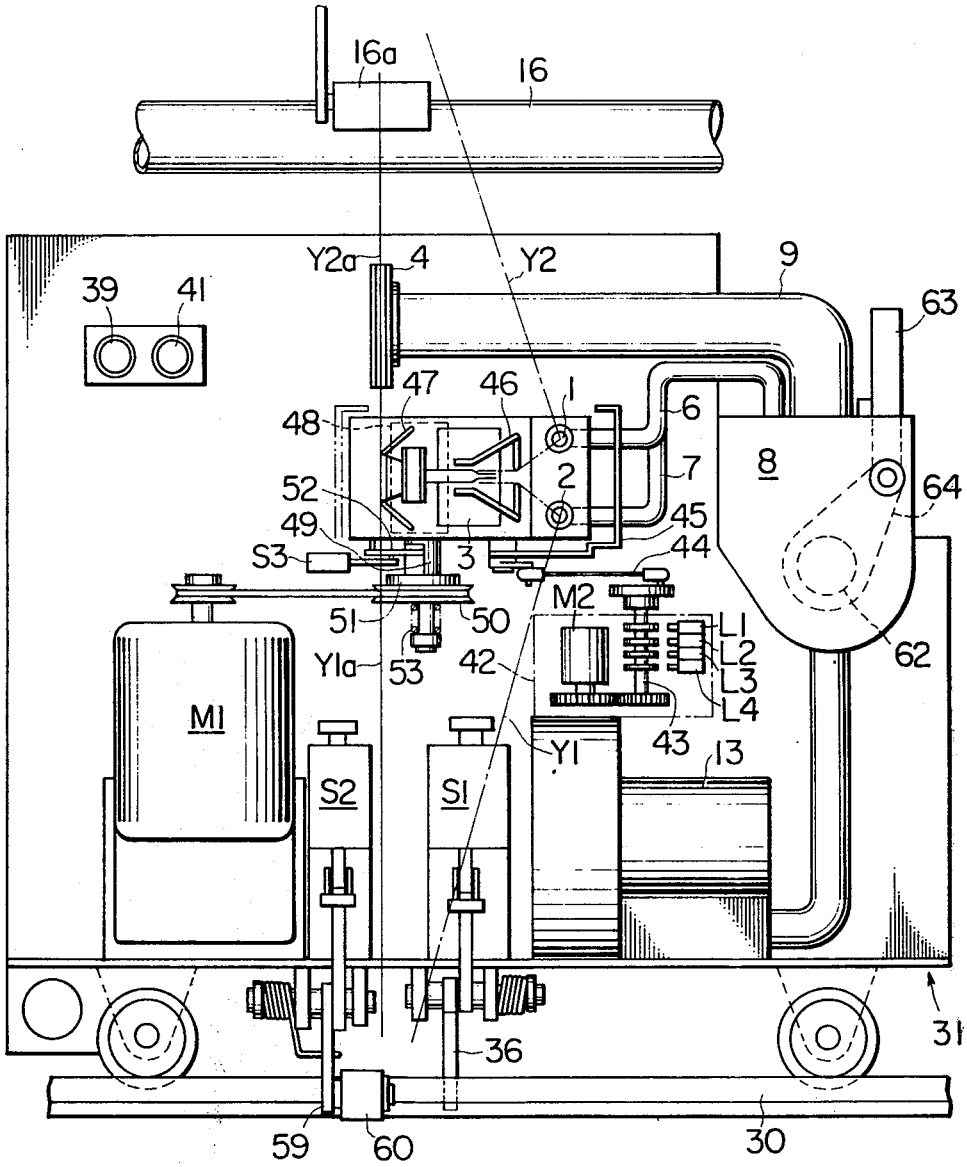
FIG. 10 is a partial front view of the spinning apparatus shown in FIG. 9.

Then, a second button 41 is depressed to start a knotter driving motor M1 and a motor M2 of a cam box 42. By rotation of the motor M2, a yarn guide wire 45 connected to a cam shaft 43 by a clank mechanism 44 is turned from the position indicated by a solid line to the position indicated by a dotted line, and yarn ends at the positions Y1 and Y2 are guided to the positions Y1*a* and Y2*a* by guide wires 46 and 47 and both the yarns are thus inserted into the knotter 3. At this time, the yarn Y2*a* is caught by a nip roller 16*a*, and the yarn Y2*a* between the knotter 3 and the nip roller 16*a* is caused to pass along the suction opening 4*b* of the yarn slackening suction pipe 4 as shown in FIGS. 2 and 10. At this moment, since the sucking force of the suction pipe 1 is larger than the sucking force of the yarn slacking suction pipe 4, the yarn is not sucked into the interior of the yarn slackening suction pipe 4.

Figure 11:
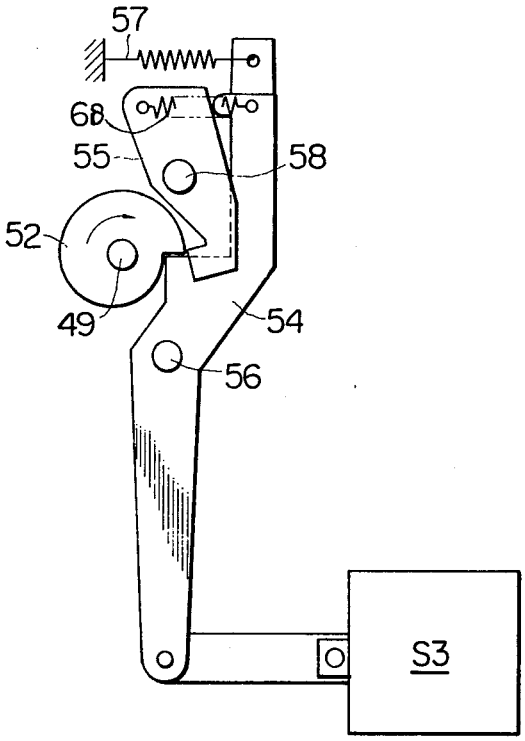
FIG. 11 is a partial enlarged plan view showing a mechanism for driving and stopping a knotter.
Figure 12:
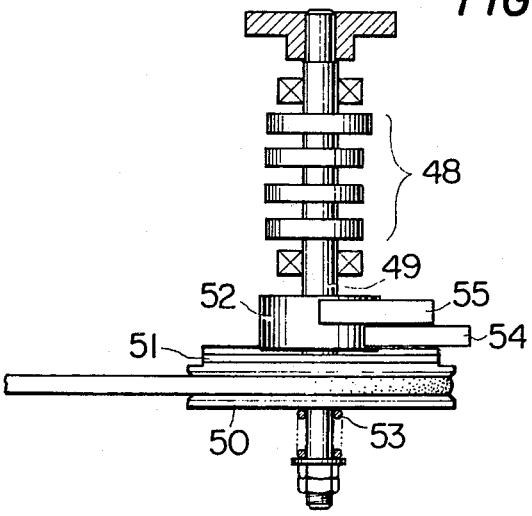
FIG. 12 is a partial enlarged front view of the mechanism shown in FIG. 11.

The knotter is constructed so that it can perform the intended operation assuredly at a high speed. More specifically, a ratchet wheel 52 having one hook stage portion is fixed to a cam shaft 49 of knotter cams 48, which is rotated through a friction plate 51 by a pulley 50 rotated by the knotter motor M1, and the pulley 50 is pressed to the friction plate 51 by a spring 53. First and second levers 54 and 55 to be engaged with the stage portion of the ratchet wheel 52 are disposed to operate and stop the knotter cam shaft. The intermediate portion of the first lever 54 is supported by a pin 56, and one end of the first lever 54 is always pressed to the ratchet wheel 52 by means of a spring 57 and this end is engaged with the hook stage portion of the ratchet wheel before actuation of the knotter. The other end of the first lever 54 is connected to a solenoid S3. The second lever 55 is supported by a pin 58, and one end of the second lever 55 is connected to the first lever 54 by a spring 68. The second lever 55 is located so that it is engaged with the hook stage portion of the ratchet wheel 52 prior to the first lever 54, and before actuation of the knotter, the engagement with the ratchet wheel is released as shown in FIG. 11. Limit switches L1, L2, L3 and L4 are actuated by cams on the cam shaft 43. More specifically, when the yarn guide wire 45 is shifted from the position indicated by a solid line to the position indicated by a dotted line in FIG. 10, the solenoid S3 is excited by the limit switch L1 to turn the first lever 54 to the right, whereby the engagement between the ratchet wheel 52 and the first lever 54 is released, and rotation of the pulley 50 is transmitted to the ratchet wheel 52 through the friction plate 51, whereby the cam shaft 49 is rapidly rotated to turn the cams 48 and operate the respective members of the knotter by the cams 48 to effect the yarn knotting operation. Simultaneously with actuation of the solenoid S3, by the action of the first lever 54 the second lever 55 connected to the first lever 54 by the spring 68 is strongly pressed to the ratchet wheel 52, and in this state, the ratchet wheel 52 makes substantially one rotation and the top end of the second lever 55 falls in engagement with the hook stage portion of the ratchet wheel 52 to stop the rotation of the cam shaft 49 and thus stop the knotter. Then, the actuation of the solenoid S3 is stopped, and the first lever 54 is returned to the position shown in FIG. 11 and simultaneously, the top end of the first lever 54 presses the top end of the second lever 55 to turn the second lever 55 to the left. Thus, the ratchet wheel 52 is released from the engagement with the second lever 55 and it completes one rotation and stands by for engagement with the first lever 54.

Simultaneously with or slightly after actuation of the limit switch L1, the limit switch L2 is put on to project a solenoid S2, and a lever 61 integrated with the cradle arm 22 is pressed down by a roller 60 disposed on the top end of a lever 59 to raise the cradle arm 22 against the brake shoe 37 and press the package 19 to the roller 18, whereby the package 19 is driven and rotated. Then, the limit switch L3 is put on to de-energize the solenoid S1, whereby the lever 36 is lifted up and the brake shoe 37 is separated from the lever 38. Thus, the lever 36 is separated from the recess 30*a*, and when the limit switch L4 is then put on, the cam shaft 43 is stopped after completion of one rotation.

An opening 62 is formed on the filter box 8, and this opening 62 is always closed by a shutter 64 integrated with a lever 63. As shown in FIG. 13, an opening 65 connected to a yarn waste collecting duct 67 and a dog 66 are disposed on the end of a machine stand. When the truck 31 arrives at the end of the machine stand, the lever 63 hits on the dog 66 and the opening 62 is opened by the shutter 64 and is connected to the opening 65, whereby yarn wastes accumulated in the filter box 8 are discharged into the waste collecting duct 67.

In general, the yarn slackening suction pipe 4 is disposed perpendicularly to the longitudinal direction of the machine stand. However, in the case where the yarn speed is high and a large space is required because of increase of the length of the slackened portion of the yarn, the yarn slackening suction pipe 4 is disposed in a manner inclined by an angle $\theta$ from a direction perpendicular to the longitudinal direction of the machine stand as indicated by a dotted line in FIG. 1.

The size of the clearance formed on the yarn slackening suction pipe is not particularly critical in the present invention, but in practical operations, for example, the following configuration is adopted for the clearance of the yarn slackening suction pipe.

Figure 14:
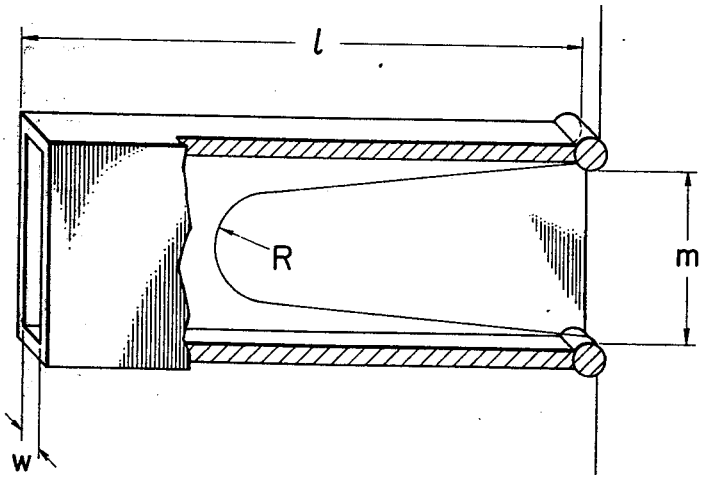
FIG. 14 is a partially cut-out perspective view illustrating the portion of the yarn slackening suction pipe in the spinning apparatus.

In the embodiment shown in FIG. 14, if, for example, the yarn speed is 200 m/min, the ratio of the peripheral speed of the take-out roller to the peripheral speed of the winding package is 1/1.1 and the operation time of the knotter is 0.06 second, good results are obtained when $m$ is about 90 mm, $l$ is about 200 mm and $w$ is about 4 mm ($Ne10'^S \sim Ne60'^S$).

In this configuration, if the radius of curvature is larger than 40 mm, no entanglement is caused in the slackened portion of the yarn. As about 200 mm of the yarn is spun out during a period of 0.06 second, when $m$ is 90 mm, the length $l$ of 100 mm seems sufficient, but in order to compensate the delay in rotation of the package or the like, it is necessary that the length $l$ should be two times the above critical value, namely 200 mm. When the ratio of the peripheral speed of the take-out roller to the peripheral speed of the winding package is 1/1, the length of the slackened portion of the yarn is increased, but in this case, the length $l$ of about 400 mm is sufficient.

What is claimed is:

1. A yarn piecing and knotting device for use in piecing broken yarn in a pneumatic spinning apparatus, which is disposed between a take-out roller and a winding package in the pneumatic spinning apparatus, said piecing device comprising a spun yarn sucking pipe for sucking and attracting a yarn spun through the take-out roller, a separate wound yarn sucking pipe for sucking and catching a broken yarn end from the winding package, a knotter for knotting the sucked spun yarn with the sucked wound yarn, and a retaining means for retaining a yarn spun from the spinning apparatus during a period ranging from the time of completion of the operation of the knotter to the time of resumption of the winding operation only, in a slackened U shape configuration by the force of air, said retaining means being disposed between the take-out roller and the spun yarn sucking pipe.

2. A yarn piecing and knotting device as set forth in claim 1 wherein in the yarn retaining and slackening means, slackening of the yarn in a U-figured shape is accomplished by the force of sucked air.

3. A yarn piecing and knotting device as set forth in claim 1 wherein in the yarn retaining and slackening means, slackening of the yarn in a U-figured shape is accomplished by the force of jetted air.

4. A yarn piecing and knotting device as set forth in claim 2 wherein the yarn retaining and slackening means is a yarn slackening suction pipe having a long slit-like interior closed at one end thereof having a section extending in the direction of the yarn passage and a yarn sucking opening at the other end thereof, an air suction pipe being connected to the one end of said yarn slackening suction pipe.

5. A yarn piecing and knotting device as set forth in claim 3 wherein the yarn retaining and slackening means is a yarn slackening suction pipe having a long slit-like interior having a section extending in the direction of the yarn passage, a yarn sucking opening at one end thereof, an opening at the other end thereof, and an air jetting opening formed on the side wall of the yarn slackening suction pipe and means for jetting air through the air jetting opening toward the other end of the yarn slackening suction pipe.

6. A yarn piecing and knotting device as set forth in claim 5 wherein a plurality of air jetting openings are formed on the side wall of the yarn slackening suction pipe spaced apart in the longitudinal direction of the yarn slackening suction pipe and air is jetted through all of the openings.

7. A yarn piecing and knotting device as set forth in claim 5 wherein a plurality of air jetting openings are formed on the side wall of the yarn slackening suction pipe and are arranged in spaced apart relation in a direction perpendicular to the longitudinal direction of the yarn slackening suction pipe.

8. A yarn piecing and knotting device as set forth in claim 4 wherein a separator extending in the longitudinal direction of the yarn slackening suction pipe is fixed to one side wall of the yarn slackening suction pipe at the central portion thereof to separate the U-shaped slack of the yarn into upper and lower portions.

9. A yarn piecing and knotting device as set forth in claim 6 wherein a plurality of air jetting openings are formed on the side wall of the yarn slackening suction pipe and are arranged in spaced apart relation in a direction perpendicular to the longitudinal direction of the yarn slackening suction pipe.

10. A yarn piecing and knotting device as set forth in claim 5 wherein a separator extending in the longitudinal direction of the yarn slackening suction pipe is fixed to one side wall of the yarn slackening suction pipe at the central portion thereof to separate the U-shaped slack of the yarn into upper and lower portions.

11. A yarn piecing and knotting device as set forth in claim 1 wherein the retaining means comprises a hollow elongated rectangular member having a slot in one side thereof adjacent one end thereof for receiving spun yarn to be held in a slackened U-shaped configuration within the rectangular member by the force of air, guide means at each end of the slot having a V-shaped configuration extending perpendicularly to the one side of the rectangular member, and means for passing air through the rectangular member from the one end to the other end thereof.

12. Structure as set forth in claim 11 wherein the means for passing air through the rectangular member comprises a manifold positioned over the one end of the rectangular member and an air pipe connected to the manifold for passing air into the manifold and through the rectangular member.

13. Structure as set forth in claim 11 wherein the means for passing air through the rectangular member comprises a manifold positioned over the other end of the rectangular member, and an air pipe secured to the manifold for sucking air from the manifold through the rectangular member.

* * * * *